US005855329A

United States Patent [19]

Pagano

[11] Patent Number: 5,855,329

[45] Date of Patent: Jan. 5, 1999

[54] BOOK HOLDER

[76] Inventor: Samuel Pagano, 1632 Squaw Creek, Girard, Ohio 44420

[21] Appl. No.: 744,470

[22] Filed: Nov. 7, 1996

[51] Int. Cl.[6] ..... A47B 97/04

[52] U.S. Cl. ..... 248/451; 248/452; 248/444.1

[58] Field of Search ..... 248/441.1, 444.1, 248/451, 452

[56] References Cited

U.S. PATENT DOCUMENTS

| | | | |
|---|---|---|---|
| 456,089 | 7/1891 | Harrison | 248/452 |
| 1,899,404 | 2/1933 | White . | |
| 2,156,225 | 4/1939 | O'Meara . | |
| 2,441,932 | 5/1948 | Curry . | |
| 3,076,285 | 2/1963 | Sparkman | 248/451 X |
| 3,813,075 | 5/1974 | Capper | 248/451 X |
| 4,116,413 | 9/1978 | Andersen | 248/451 |
| 4,116,414 | 9/1978 | Robertson . | |
| 4,712,760 | 12/1987 | Winter . | |
| 5,052,650 | 10/1991 | Beile et al. . | |
| 5,366,197 | 11/1994 | Westland | 248/452 X |
| 5,580,024 | 12/1996 | Briee | 248/451 X |

*Primary Examiner*—Milton Nelson, Jr.
*Attorney, Agent, or Firm*—Harpman & Harpman

[57] ABSTRACT

A book holder for holding and positioning books and documents. The book holder includes a document support and display surface with oppositely disposed (page) engagement clips extending from the support surface. An adjustable line guide is removably positioned on the support surface for selective vertical transgression thereover. An extensible document engagement clip extends from the top of the display surface.

10 Claims, 3 Drawing Sheets

BOOK HOLDER

BACKGROUND OF THE INVENTION

1. Technical Field

This invention relates to book and copy holders used for positioning materials so that they can be viewed by a user while performing other tasks. A book holder generally supports a book on an incline flat surface with a holding means.

2. Description of Prior Art

Book and copy holders of this type have relied on a variety of useful constructions for supporting a book or papers in an upstanding position so that it can be easily read without holding same. Typically, a user would use both hands to support a book in an angled upright open position. This precludes or makes difficult for the user the use of their hands for writing or other like tasks. Alternately, books, if hardback for example, can be propped up by leaning on some article and other non-rigid publication require more support such a workbooks used by teachers and students that are difficult to hold open and upright required for use. A number of different book and page holders have accordingly been developed to solve this problem.

Prior art holders of this type have a support frame or surface with attachment straps, hooks or clamps to hold the book on the stand and open or a single page to be copied, for instance. Examples of such devices can be seen in U.S. Pat. Nos. 1,899,404, 2,156,225, 2,441,932, 4,416,414, 4,712,760 and 5,052,650.

In U.S. Pat. No. 1,899,404 a book holder and table can be seen having a book support platform pivotally secured to an adjustable frame stand with a center engagement clip and a pair of adjustable leaf retainers.

U.S. Pat. No. 2,156,225 is directed to a reading stand having a wire support construction, a book engagement plate and multiple pivoted spring clips to hold the book open positioned within.

U.S. Pat. No. 2,441,932 shows an easel type support having a pair of criss-cross collapsible X-shaped support frame elements pivotally secured together with a resistance chain therebetween on an easel support. Page clips are removably secured to a central cross frame member.

Referring to U.S. Pat. No. 4,116,414, a book holder can be seen having a support sheet with a pivot stand leg. A pair of clothes pins are resiliently secured to the support sheet engageable on a book position thereon.

U.S. Pat. No. 4,712,760 discloses a back rest with a page retainer having a tapered base with an insertable upstanding wall extending therefrom. Page retaining clips are adjustably positioned from the back for engagement thereover.

In U.S. Pat. No. 5,052,650 illustrates a copy holder having an upright flat surface supported by an adjustable stand with a line guide extending inwardly across the engagement surface from one side.

SUMMARY OF THE INVENTION

A book holder of the present invention for supporting and displaying books, magazines and papers in an upright angled attitude. The book holder includes an elongated angled base with an integral upstanding support surface extending at right angles thereto. An angular leg support extends from the support surface which has a movable line guide extending thereacross. A pair of oppositely disposed retaining clips extend from the support surface for bi-lateral book engagement. A top page retainer means is included to maintain page typed documents on the support surface.

DESCRIPTION OF THE PREFERRED EMBODIMENT

Figure 1:
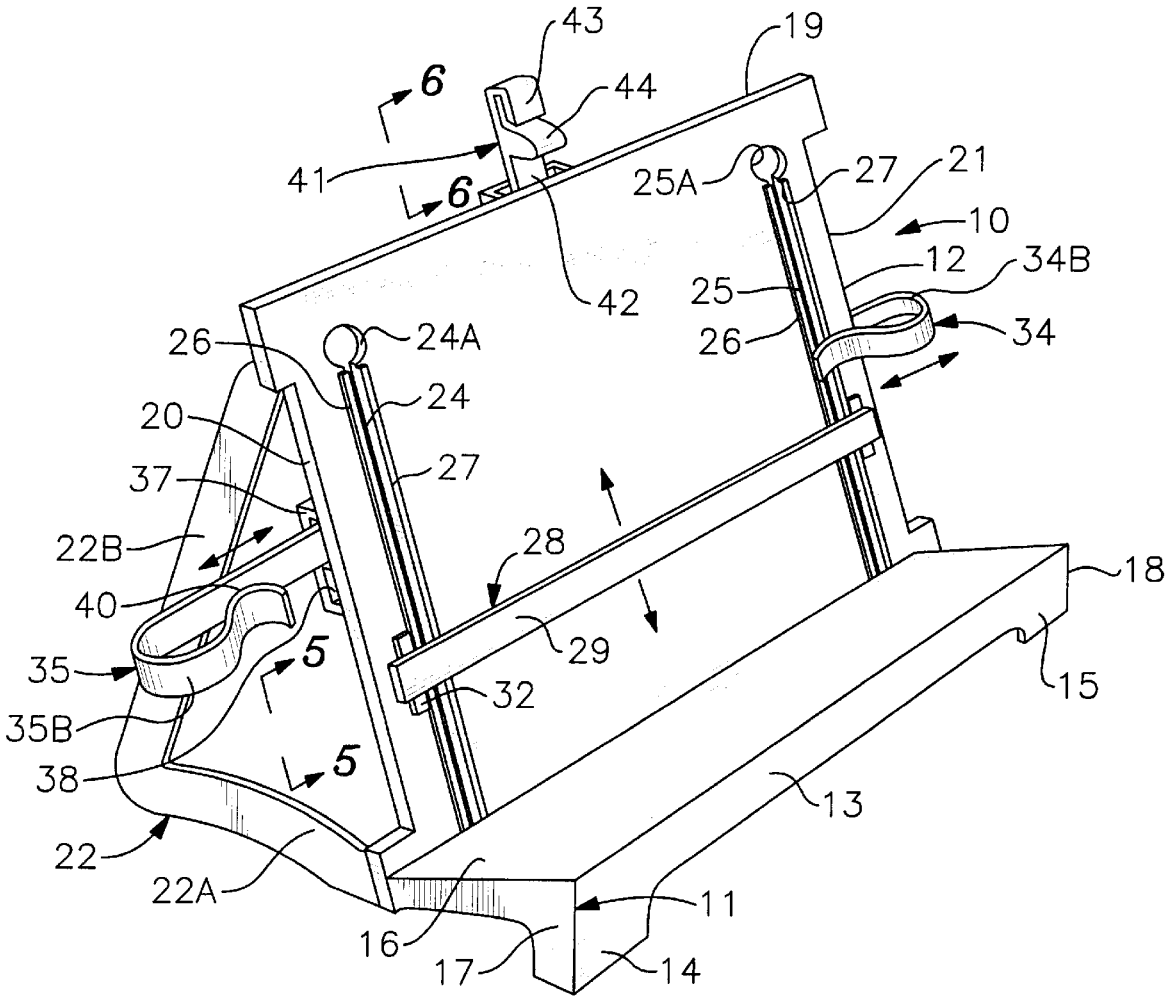
FIG. 1 a perspective view of the book holder with page retainers shown therein.
Figure 2:
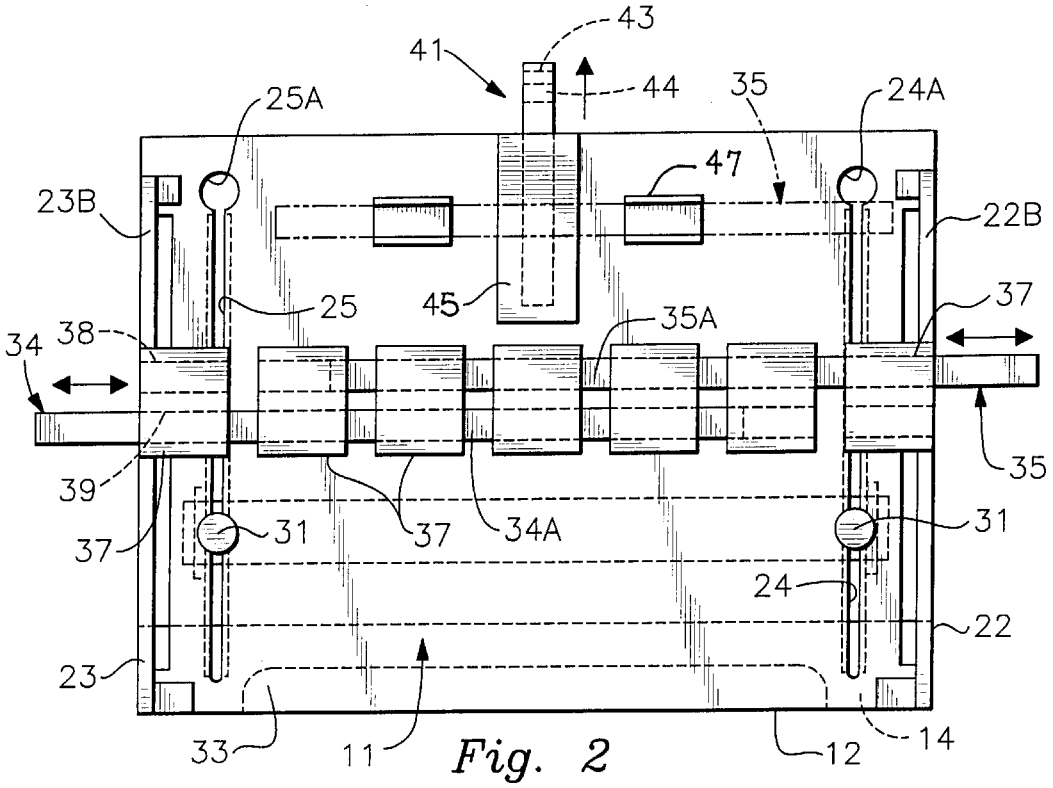
FIG. 2 is a rear elevational view of the book holder set forth in FIG. 1.

Referring to FIGS. 1 and 2 of the drawings, a book holder 10 of the invention can be seen having an inclined elongated base 11 and a support surface 12 extending therefrom. The base 11 has a front surface 13 from which are formed a pair of oppositely disposed legs 14 and 15. An inclined upper surface 16 of the base 11 extends from the front surface 13 with interconnected sidewall surfaces 17 and 18. The support surface 12 extends intrinsically from the upper surface 16 opposite said front surface 13 at a right angle thereto imparting an angled inclination to the support surface 12. The support surface 12 is generally flat having a top edge 19 and respective side edges 20 and 21. The aforedescribed integral support surface 12 is in turn supported by a pair of brackets 22 and 23 extending from the intersection of the support surface 12 and base 11 adjacent the respective top and side edges 19 and 20 and 19 and 21. The brackets 22 and 23 have respective curved base legs 22A and with integral angles braces 22B and 23B extending therefrom to the hereinbefore described support surface 12 junction of the top edge 19 and side edges 20 and 21 thereof defining a triangular area therebetween.

Figure 3:
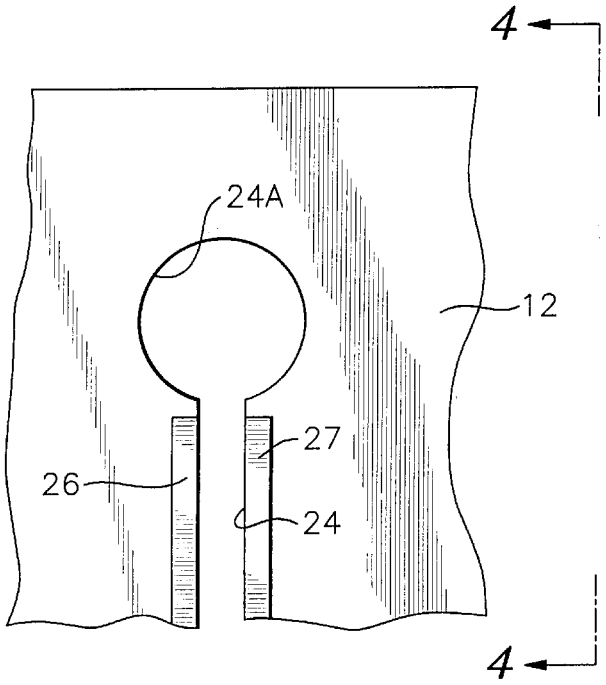
FIG. 3 is an enlarged front elevational view of a page guide receiving slot and associated end rails.
Figure 4:
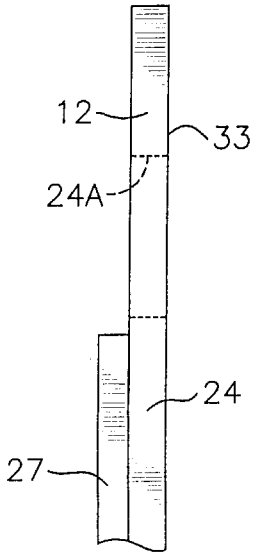
FIG. 4 is a side elevational view on lines 4—4 of FIG. 3.

The support surface 12 has a pair of oppositely disposed elongated parallel slots 24 and 25 inwardly of the respective side edges 20 and 21. The slots 24 and 25 extend from the upper surface 16 of the base 11 terminating in respective annular openings 24A and 25A adjacent the top edge 19. Each of the slots 24 and 25 have pairs of upstanding parallel guide rails 26 and 27 that extend therealong from the annular openings 24A and 25A to the upper surface 16 of the base 11, best seen in FIGS. 1, 3 and 4 of the drawings.

Figure 5:
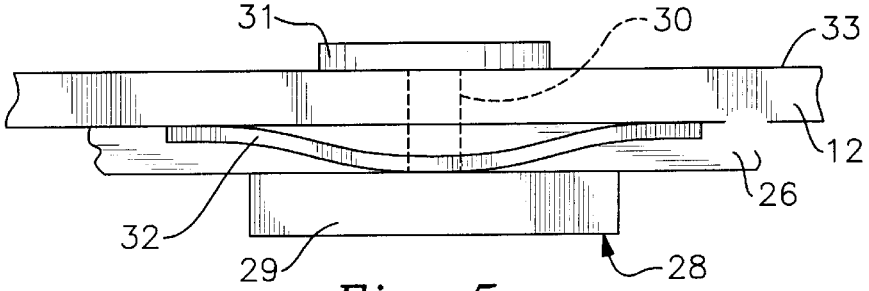
FIG. 5 an enlarged partial side elevational view of a page line guide assembly within the support surface.

Referring now to FIGS. 1 and 5 of the drawings, a line guide assembly 28 can be seen having a transparent line band 29 with engagement fittings extending therefrom for registration within the respective slots 24 and 25. Each of the engagement fittings have a pin 30 with a retaining disk 31 on its respective free end. Resilient guide leaves 32, best seen in FIG. 5 of the drawings are secured to the transparent band 29 so as to be engageable on the support surface 12 on either side of the hereinbefore described outer rails 26 and extend transversely beyond the transparent band 29 thereby defining a uniform travel path for the transparent band 29 on the rail pairs 26 and 27. It will be evident from the above description that the disks 31 are insertable through the annular openings 24A and 25A and are engageable on the support surface 12's back surface 33 overlying the slots 24 and 25.

Referring back to FIGS. 1 and 2 of the drawings, page and leaf retaining clips 34 and 35 can be seen having a pair of identical elongated hooks extending from multiple horizontally aligned and longitudinally spaced mounting brackets 37 on the back surface 33 of the support surface 12. Each of the mounting brackets 37 are generally rectangular with parallel transversely extending openings 38 and 39 therethrough that are aligned with openings and adjacent brackets 37 to form respective parallel guide channels there between best seen in FIG. 2 of the drawings. The The retaining clips 34 and 35 have a cross-sectionally rectangular elongated guide channel engagement portion 34A and 35A respectively with a compound curved end portion that returns upon itself to define a resilient engagement area therebetween at 40 as will be understood by those skilled in the art.

The guide channel engagement portions of the retaining clips 34 and 35 are registerable within said respective guide openings 38 and 39 from opposing side edges 20 and 21 so as to selectively overlie the support surface 12 or alternately be adjustably positioned therebeyond for engagement of a book (not shown) positioned on or extending beyond the support surface 12.

Figure 6:
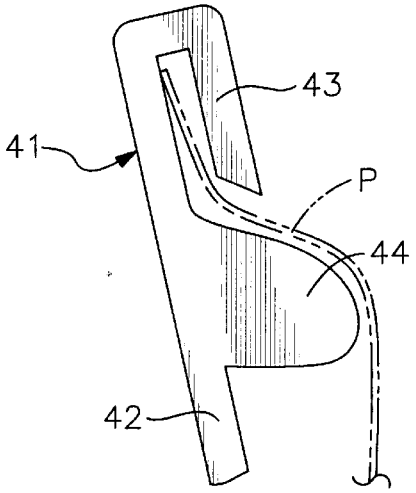
FIG. 6 is an enlarged side elevational view of a page engagement means with portions broken away.
Figure 7:
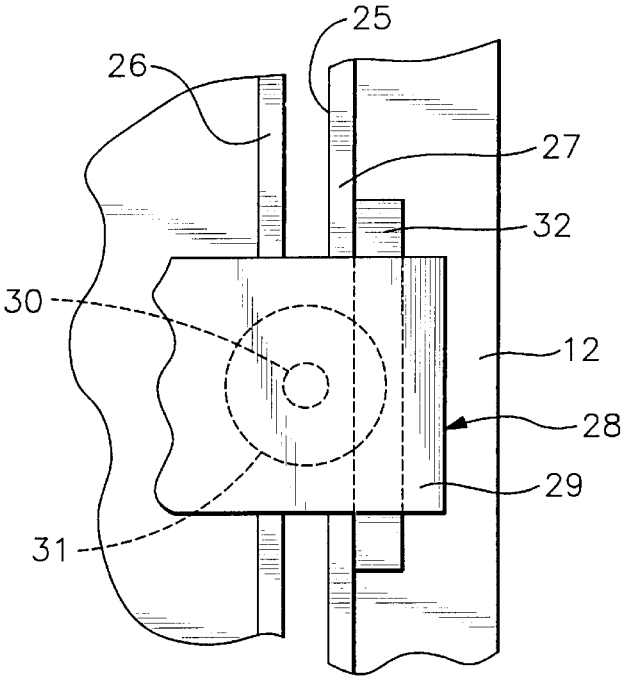
FIG. 7 is an enlarged top plan view of a portion of the page line guide illustrated in FIG. 5.

A page retaining clip 41, best seen in FIGS. 1, 2, and 6 of the drawings, extends from the back surface 33 of the support surface 12 beyond the top edge 19. The retaining clip 41 has an elongated cross-sectionally rectangular main body member 42 with an end return portion 43 and a paper engagement spacing lug 44 in vertical spaced relation therebelow.

An enclosed support channel 45 is formed on the back surface 33 of the support surface 12 midway between the respective side edges 20 and 21. The page retaining clip 41 is registerably received within the support channel 45 and is adjustably deployed therefrom above the top edge 19, as required.

It will be apparent to those skilled in the art that the end return portion 43 of the retaining clip 41 is configured with engagement retaining convexed areas CA frictionally engaged within said enclosed support channel 45.

In use, the book holder 10 of the invention can receive and hold open a book (not shown) on its angled support surface 12 resting on the base 11 with the respective retaining clips 34 and 35 horizontally adjustable within the respective guide openings 38 and 39 so as to be engageable over the respective portions of the book (not shown) as will be well understood by those skilled in the art.

In use, for a single sheet or a page (P) the same is positioned on the support surface 12 and the line guide assembly 28 is positioned thereover with the page retaining clip 41 engageable on the free end of the page P as illustrated in FIG. 6 of the drawings.

Referring now to FIG. 2 of the drawings, a pair of retaining clips 47 extend from the back surface 33 of the support surface 12 on oppositely disposed sides of the enclosed supporting channel 45 for registration storage of the respective page retaining clips 34 and 35 shown in broken lines as will be well understood by those skilled in the art.

Thus it will be seen that a new and useful book holder has been illustrated and described and it will be apparent to those skilled in the art that various changes and modifications may be made therein without departing from the spirit of the invention.

Therefore I claim:

1. A book holder for supporting books and papers comprising; a base, having a front surface, interconnected side surfaces, and an upper surface, a document support surface extending from said upper surface, a bracket structure extending from said document support surface, said bracket structure including base legs with braces extending therefrom engaging said support surface in spaced vertical relation to said base legs, a pair of spaced parallel slots in said document support surface, a line guide registerable within and extending between said slots, means for spacing said line guide from said support surface, page engagement clips extending from said support surface, means for selective extension of said engagement clips on said document support surface, said page engagement clips having resilient end portions, a page retaining clip mounted on said support surface.

2. The book holder as set forth in claim 1 wherein said upper surface of said base is angularly inclined from said front surface to said document support surface.

3. The book holder as set forth in claim 1 wherein said document support surface is generally flat and is in a leaning attitude away from said front surface of said base and at right angles to said upper surface of said base.

4. The book holder as set forth in claim 1 wherein said bracket structure defines a triangular area between the leg and brace and support surface.

5. The book holder as set forth in claim 1 wherein said means for spacing said line guide from said support surface comprises: pairs of rails on said support surface adjacent said parallel slots.

6. The book holder set forth in claim 1 wherein said page engagement clips are cross-sectionally rectangular having compound curved end portions defining a resilient engagement portion therebetween.

7. The book holder of claim 1 wherein said means for selective extension of said engagement clips from said support surface comprises: a plurality of mounting brackets on a back surface of said support surface, said mounting brackets defining a pair of segmented guide channels therebetween.

8. The book holder as set forth in claim 1 wherein said page retaining clip comprises: an elongated body member, an end return of said body member, a lug in said body member adjacent said return, a mounting support channel on said document support surface.

9. The book holder of claim 1 wherein said line guide comprises: a guide band, oppositely disposed retaining assemblies extending therefrom, said retaining assemblies registerable through said respective slots in said support surface.

10. The book holder of claim 9 wherein said retaining assembly comprises: a pin extending from said guide band, a retaining disk on the end of said pin, a guide leaf extending from said guide band, said retaining disk registerable through apertures in said support surface interconnected with said slots.

* * * * *